US007643132B2

(12) United States Patent
Holmberg

(10) Patent No.: US 7,643,132 B2
(45) **Date of Patent: *Jan. 5, 2010**

(54) RANGE FINDER

(76) Inventor: Larry Holmberg, P.O. Box 63, Wascott, WI (US) 54890

( * ) Notice: Subject to any disclaimer, the term of this patent is extended or adjusted under 35 U.S.C. 154(b) by 116 days.

This patent is subject to a terminal disclaimer.

(21) Appl. No.: 11/106,828

(22) Filed: Apr. 15, 2005

(65) Prior Publication Data

US 2005/0195385 A1 Sep. 8, 2005

Related U.S. Application Data

(63) Continuation-in-part of application No. 11/018,960, filed on Dec. 21, 2004, now Pat. No. 7,100,321, and a continuation of application No. 10/641,169, filed on Aug. 14, 2003, now Pat. No. 6,988,331, and a continuation of application No. 10/090,333, filed on Mar. 4, 2002, now Pat. No. 6,615,531.

(51) Int. Cl.
*G01C 3/08* (2006.01)
*G01C 9/00* (2006.01)
*F41G 1/393* (2006.01)

(52) U.S. Cl. ..... 356/5.02; 356/4.01; 356/247; 42/119

(58) Field of Classification Search ..... 356/4.01, 356/5.15, 251, 247; 42/75.01, 124, 127
See application file for complete search history.

(56) References Cited

U.S. PATENT DOCUMENTS

| | | | |
|---|---|---|---|
| 521,761 | A | 6/1894 | Day |
| 547,912 | A | 10/1895 | Crupe |
| 619,214 | A | 2/1899 | Paul |
| 674,229 | A | 5/1901 | Windle |
| 845,165 | A | 2/1907 | Davis |
| 899,639 | A | 9/1908 | Vibber |
| 1,452,651 | A | 4/1923 | Norrlin |
| 1,480,147 | A | 1/1924 | Fokko |
| 2,101,479 | A | 12/1937 | Schenk |
| 2,450,466 | A | 10/1948 | Carlson |
| 2,814,118 | A | 11/1957 | Evans et al. |
| 3,427,102 | A | 2/1969 | Wade |
| 3,483,623 | A | 12/1969 | Kruzell |
| 3,684,376 | A | 8/1972 | Lessard |

(Continued)

FOREIGN PATENT DOCUMENTS

EP 1804017 A1 7/2004

(Continued)

OTHER PUBLICATIONS

Improved Construction Methods, "Laser Measuring System, Impulse LX", http://www.improvedconstructionmethods.com/impulse_xl.htm, May 20, 2001.

(Continued)

*Primary Examiner*—Isam Alsomiri
(74) *Attorney, Agent, or Firm*—Kinney & Lange, P.A.

(57) ABSTRACT

A range finder adapted to be mounted to a scope. The range finder includes a main housing, range finding circuit received in the main housing and a mounting mechanism adapted to mount the main housing to a scope.

14 Claims, 4 Drawing Sheets

U.S. PATENT DOCUMENTS

| | | | | |
|---|---|---|---|---|
| 3,684,378 | A | 8/1972 | Lord | |
| 3,737,232 | A * | 6/1973 | Milburn, Jr. | 356/18 |
| 3,782,822 | A | 1/1974 | Spence | |
| 3,785,261 | A | 1/1974 | Ganteaume | |
| 3,834,052 | A | 9/1974 | Steck, III | |
| 4,000,403 | A | 12/1976 | Rice | |
| 4,026,054 | A | 5/1977 | Snyder | |
| 4,027,414 | A | 6/1977 | Felix | |
| 4,069,414 | A | 1/1978 | Bell | |
| 4,223,770 | A | 9/1980 | Kranz | |
| 4,233,770 | A | 11/1980 | de Fillippis et al. | |
| 4,283,743 | A | 8/1981 | Kaiser | |
| T101,001 | I4 | 9/1981 | Shipp et al. | |
| 4,296,725 | A | 10/1981 | Broderick | |
| D268,910 | S | 5/1983 | Shipp et al. | |
| 4,514,907 | A | 5/1985 | Saltzman | |
| 4,516,296 | A | 5/1985 | Sherman | |
| 4,531,052 | A | 7/1985 | Moore | |
| 4,561,204 | A * | 12/1985 | Binion | 42/122 |
| 4,564,322 | A | 1/1986 | Stapley | |
| 4,597,211 | A | 7/1986 | Miles | |
| 4,606,629 | A | 8/1986 | Hines et al. | |
| 4,617,741 | A | 10/1986 | Bordeaux et al. | |
| 4,640,258 | A | 2/1987 | Penney et al. | |
| 4,643,159 | A | 2/1987 | Ryan | |
| 4,730,190 | A | 3/1988 | Win et al. | |
| 4,753,528 | A | 6/1988 | Hines et al. | |
| 4,777,352 | A | 10/1988 | Moore | |
| 4,786,204 | A | 11/1988 | Mayeda | |
| 4,786,966 | A | 11/1988 | Hanson et al. | |
| 4,827,348 | A | 5/1989 | Ernest et al. | |
| 4,835,621 | A | 5/1989 | Black | |
| 4,884,137 | A | 11/1989 | Hanson et al. | |
| 4,890,128 | A | 12/1989 | Kania | |
| 4,910,717 | A | 3/1990 | Terry | |
| 4,939,863 | A | 7/1990 | Alexander et al. | |
| 4,970,589 | A | 11/1990 | Hanson et al. | |
| 4,974,575 | A | 12/1990 | Mitchell | |
| D313,361 | S | 1/1991 | Robinson | |
| 4,993,833 | A | 2/1991 | Lorey et al. | |
| 4,996,866 | A | 3/1991 | Masera et al. | |
| 5,005,213 | A | 4/1991 | Hanson et al. | |
| 5,020,262 | A | 6/1991 | Pena | |
| 5,026,158 | A * | 6/1991 | Golubic | 356/252 |
| 5,033,219 | A | 7/1991 | Johnson et al. | |
| 5,161,310 | A | 11/1992 | Stoot | |
| 5,200,827 | A | 4/1993 | Hanson et al. | |
| 5,262,837 | A | 11/1993 | Shyy | |
| 5,265,896 | A | 11/1993 | Kravitz | |
| 5,297,533 | A | 3/1994 | Cook | |
| 5,326,061 | A | 7/1994 | Hamilton | |
| 5,339,793 | A | 8/1994 | Findley | |
| 5,373,657 | A | 12/1994 | Betz et al. | |
| 5,418,609 | A | 5/1995 | Dunne | |
| 5,455,625 | A | 10/1995 | Englander | |
| 5,456,157 | A | 10/1995 | Lougheed et al. | |
| 5,479,712 | A | 1/1996 | Hargrove et al. | |
| 5,507,272 | A | 4/1996 | Scantlen | |
| 5,520,164 | A | 5/1996 | Huddleston | |
| D371,084 | S | 6/1996 | Ogawa | |
| 5,531,149 | A | 7/1996 | Schubert et al. | |
| 5,555,665 | A | 9/1996 | Fore | |
| 5,575,072 | A | 11/1996 | Eldridge | |
| 5,606,818 | A * | 3/1997 | Hardee | 42/124 |
| 5,611,324 | A | 3/1997 | Kursinsky | |
| 5,669,147 | A | 9/1997 | Nakajima et al. | |
| 5,669,174 | A * | 9/1997 | Teetzel | 42/115 |
| 5,686,690 | A | 11/1997 | Lougheed et al. | |
| 5,687,910 | A | 11/1997 | King | |
| 5,711,104 | A | 1/1998 | Schmitz | |
| D390,483 | S | 2/1998 | Zykan et al. | |
| 5,739,859 | A | 4/1998 | Hattori et al. | |
| 5,815,251 | A | 9/1998 | Ehbets et al. | |
| 5,822,621 | A | 10/1998 | Szajewski | |
| 5,831,718 | A * | 11/1998 | Desai et al. | 356/5.01 |
| 5,834,676 | A | 11/1998 | Elliott | |
| 5,845,165 | A | 12/1998 | McMahan | |
| 5,859,693 | A | 1/1999 | Dunne et al. | |
| 5,887,375 | A | 3/1999 | Watson | |
| 5,892,617 | A | 4/1999 | Wallace | |
| 5,895,131 | A | 4/1999 | Yano | |
| 5,911,215 | A | 6/1999 | Fisher, Jr. | |
| 5,926,260 | A | 7/1999 | Dunne et al. | |
| 5,937,562 | A | 8/1999 | Brough | |
| 5,944,041 | A | 8/1999 | Kitchens | |
| 5,949,529 | A | 9/1999 | Dunne et al. | |
| 5,964,054 | A | 10/1999 | Galfidi, Jr. | |
| 5,973,315 | A | 10/1999 | Saldana et al. | |
| D421,229 | S | 2/2000 | Imai | |
| 6,029,643 | A | 2/2000 | Golfieri | |
| 6,070,355 | A | 6/2000 | Day | |
| 6,073,352 | A | 6/2000 | Zykan et al. | |
| D432,930 | S | 10/2000 | Sanoner | |
| 6,137,564 | A | 10/2000 | Schmidt et al. | |
| 6,154,971 | A | 12/2000 | Perkins | |
| 6,192,614 | B1 | 2/2001 | Cliburn | |
| 6,252,706 | B1 * | 6/2001 | Kaladgew | 359/399 |
| 6,269,581 | B1 * | 8/2001 | Groh | 42/122 |
| D448,315 | S | 9/2001 | Ito | |
| 6,286,796 | B1 | 9/2001 | Pugliesi | |
| 6,288,386 | B1 | 9/2001 | Bowen et al. | |
| 6,296,581 | B1 | 10/2001 | Sever | |
| 6,304,289 | B1 | 10/2001 | Sakai et al. | |
| 6,331,887 | B1 | 12/2001 | Shiraishi et al. | |
| 6,336,285 | B1 | 1/2002 | Baumer | |
| 6,341,201 | B1 | 1/2002 | Ishiguro et al. | |
| 6,396,571 | B2 | 5/2002 | Ohtomo et al. | |
| 6,397,483 | B1 | 6/2002 | Perkins | |
| 6,398,571 | B1 | 6/2002 | Nishide et al. | |
| 6,408,140 | B1 | 6/2002 | Malloy Desormeaux | |
| D460,367 | S | 7/2002 | Apothéloz et al. | |
| D460,368 | S | 7/2002 | Apothéloz et al. | |
| D460,369 | S | 7/2002 | Apothéloz et al. | |
| 6,425,697 | B1 | 7/2002 | Potts et al. | |
| 6,450,816 | B1 | 9/2002 | Gerber | |
| 6,487,809 | B1 * | 12/2002 | Gaber | 42/119 |
| 6,494,196 | B2 | 12/2002 | Harwath et al. | |
| 6,526,956 | B1 | 3/2003 | Hankins | |
| D472,826 | S | 4/2003 | Sanoner | |
| 6,556,245 | B1 | 4/2003 | Holmberg | |
| 6,598,331 | B1 | 7/2003 | Thibodeaux | |
| 6,615,531 | B1 | 9/2003 | Holmberg | |
| 6,623,182 | B2 | 9/2003 | Tatera | |
| 6,624,881 | B2 | 9/2003 | Waibel et al. | |
| 6,678,988 | B1 | 1/2004 | Poff, Jr. | |
| 6,681,755 | B2 | 1/2004 | Pujos | |
| 6,693,702 | B2 | 2/2004 | Rogers | |
| 6,704,097 | B2 | 3/2004 | Waibel et al. | |
| D488,315 | S | 4/2004 | Natuzzi | |
| 6,722,076 | B2 | 4/2004 | Nielsen | |
| 6,742,299 | B2 | 6/2004 | Strand | |
| 6,772,076 | B2 | 8/2004 | Yamamoto et al. | |
| 6,784,920 | B2 | 8/2004 | Weber | |
| 6,796,038 | B2 | 9/2004 | Humphries | |
| 6,813,025 | B2 * | 11/2004 | Edwards | 356/422 |
| 6,815,251 | B1 | 11/2004 | Akram et al. | |
| 6,819,495 | B2 | 11/2004 | Shani et al. | |
| 6,819,866 | B2 | 11/2004 | Da Silva | |
| 6,886,287 | B1 * | 5/2005 | Bell et al. | 42/120 |
| 6,886,288 | B1 | 5/2005 | Yocum et al. | |
| 6,932,305 | B2 | 8/2005 | Morales et al. | |
| 6,988,331 | B2 | 1/2006 | Holmberg | |
| 7,006,144 | B2 | 2/2006 | Holmberg | |
| 7,088,506 | B2 | 8/2006 | Regan et al. | |

| | | | | |
|---|---|---|---|---|
| 7,128,354 | B2 | 10/2006 | Wu | |
| 7,269,920 | B2 | 9/2007 | Staley, III | |
| 7,390,130 | B2 | 6/2008 | Soulvie | |
| 2002/0067475 | A1 | 6/2002 | Waibel et al. | |
| 2002/0078577 | A1 | 6/2002 | Aldred | |
| 2002/0087475 | A1 | 7/2002 | Okayama et al. | |
| 2002/0109057 | A1* | 8/2002 | Wooten et al. | 248/229.1 |
| 2002/0171755 | A1 | 11/2002 | Nishimura | |
| 2003/0013392 | A1 | 1/2003 | Guillermin | |
| 2003/0133092 | A1 | 7/2003 | Rogers | |
| 2003/0163943 | A1 | 9/2003 | Holmberg | |
| 2004/0000083 | A1* | 1/2004 | Grant, Jr. | 42/112 |
| 2004/0016169 | A1 | 1/2004 | Poff, Jr. | |
| 2004/0051865 | A1 | 3/2004 | Stierle et al. | |
| 2004/0079018 | A1 | 4/2004 | Holmberg | |
| 2004/0114129 | A1 | 6/2004 | Gogalla et al. | |
| 2004/0135991 | A1 | 7/2004 | Gagalla et al. | |
| 2004/0183942 | A1 | 9/2004 | Holmberg | |
| 2004/0194364 | A1 | 10/2004 | Holmberg | |
| 2004/0257437 | A1 | 12/2004 | Lesseu | |
| 2005/0035245 | A1 | 2/2005 | Morales et al. | |
| 2005/0123883 | A1 | 6/2005 | Kennen et al. | |
| 2005/0195385 | A1 | 9/2005 | Holmberg | |
| 2005/0241210 | A1 | 11/2005 | Karcher et al. | |
| 2005/0246910 | A1 | 11/2005 | Mowers | |
| 2005/0252062 | A1* | 11/2005 | Scrogin et al. | 42/119 |
| 2005/0268519 | A1* | 12/2005 | Pikielny | 42/124 |
| 2005/0268521 | A1 | 12/2005 | Cox et al. | |
| 2006/0010761 | A1 | 1/2006 | Staley, III | |
| 2006/0215149 | A1 | 9/2006 | LaBelle et al. | |
| 2007/0008187 | A1 | 1/2007 | Schmidt | |
| 2007/0031142 | A1 | 2/2007 | Moody et al. | |
| 2007/0068018 | A1 | 3/2007 | Gilmore | |
| 2007/0081817 | A1 | 4/2007 | Soulvie | |
| 2007/0157502 | A1 | 7/2007 | Holmberg | |
| 2007/0157503 | A1 | 7/2007 | Holmberg | |
| 2007/0277421 | A1 | 12/2007 | Perkins et al. | |
| 2008/0000465 | A1 | 1/2008 | Holmberg | |
| 2008/0060248 | A1 | 3/2008 | Pine et al. | |

FOREIGN PATENT DOCUMENTS

| | | | |
|---|---|---|---|
| EP | 1804017 | A1 | 7/2007 |
| GB | 2 024 558 | A | 1/1980 |
| GB | 2024558 | A | 1/1980 |
| GB | 2 114 770 | A | 8/1983 |
| GB | 2114770 | A | 8/1983 |
| WO | WO 90/12330 | | 10/1990 |
| WO | WO9012330 | | 10/1990 |
| WO | 2006090356 | A1 | 8/2006 |
| WO | WO2006090356 | A1 | 8/2006 |
| WO | 2006133029 | A2 | 12/2006 |
| WO | WO2006133029 | A2 | 12/2006 |

OTHER PUBLICATIONS

"Specification Sheet on the Impulse 200 LR Laser (Rangefinder)," Nov. 15, 2003, Publisher: Laser Technology Inc.

* cited by examiner

RANGE FINDER

CROSS-REFERENCE TO RELATED APPLICATIONS

This application is a continuation in part application of U.S. application Ser. No. 11/018,960, filed on Dec. 21, 2004, which is herein incorporated by reference. Further, U.S. application Ser. No. 11/018,960 is a continuation of U.S. application Ser. No. 10/641,169, filed Aug. 14, 2003 and titled "RANGE FINDER," which is herein incorporated by reference. Further, U.S. application Ser. No. 10/641,169, filed Aug. 14, 2003 is a continuation application of U.S. Pat. No. 6,615,531 and titled "RANGE FINDER," which is herein incorporated by reference and claimed in priority.

TECHNICAL FIELD

The present invention relates generally to range finders and in particular range finders for hunting applications.

BACKGROUND

Range finders can be a useful tool when hunting for game. A ranger finder conveys the distance to an object (game target). This information is helpful to a hunter because it allows a hunter to determine if the target is beyond the range of a firearm or bow. Knowing the distance to a target also aids the hunter in the placement of the sight of the firearm or bow. For example, if the target is a great distance from a firearm, a hunter can raise the sight of the firearm over the target a select distance to compensate for the trajectory of a projectile (bullet) fired from the firearm. The distance found by the range finder can aid the hunter in determining how much the sight should be raised over the target.

Traditional range finders can be disruptive in a hunting situation. The hunter must operate the hunting weapon and the range finder at the same time. Moreover, telescopes incorporating range finder circuits are generally heavy, bulky and expensive to purchase.

For the reasons stated above and for other reasons stated below which will become apparent to those skilled in the art upon reading and understanding the present specification, there is a need in the art for an inexpensive range finder that is non-disruptive to operate in a hunting situation.

SUMMARY

The above mentioned problems with range finders and other problems are addressed by the present invention and will be understood by reading and studying the following specification.

In one embodiment, a range finder circuit is provided. The range finder includes a main housing. A range finding circuit received in the main housing and a mounting mechanism that is adapted to mount the main housing to a scope.

In another embodiment, another range finder is provided. This range finder includes a main housing, a range finder circuit, a display and a mounting mechanism. The range finder circuit is contained in the main housing. The display is in communication with the range finder circuit. Moreover, the display is adapted to display distances to objects determined by the range finder circuit. The mounting mechanism is adapted to mount the main housing to a scope of a firearm.

In yet still another embodiment, still another range finder in provided. The range finder includes a main body, a range finder circuit, a display and a mounting mechanism. The main body has a signal end and a display end that is opposite the signal end. The range finder circuit is adapted to project signals and receive reflected signals through the signal end. The display is coupled to the display end and is adapted to display distances determined by the range finder circuit. The mounting mechanism is adapted to mount the range finder to a scope.

BRIEF DESCRIPTION OF THE DRAWINGS

The present invention can be more easily understood and further advantages and uses thereof more readily apparent, when considered in view of the description of the preferred embodiments and the following figures in which.

In accordance with common practice, the various described features are not drawn to scale but are drawn to emphasize specific features relevant to the present invention. Reference characters denote like elements throughout Figures and text.

DETAILED DESCRIPTION

In the following detailed description of embodiments, reference is made to the accompanying drawings, which form a part hereof, and in which is shown by way of illustration specific embodiments in which the inventions may be practiced. These embodiments are described in sufficient detail to enable those skilled in the art to practice the invention, and it is to be understood that other embodiments may be utilized and that logical, mechanical and electrical changes may be made without departing from the spirit and scope of the present invention. The following detailed description is, therefore, not to be taken in a limiting sense, and the scope of the present invention is defined only by the claims and equivalents thereof.

Figure 1:
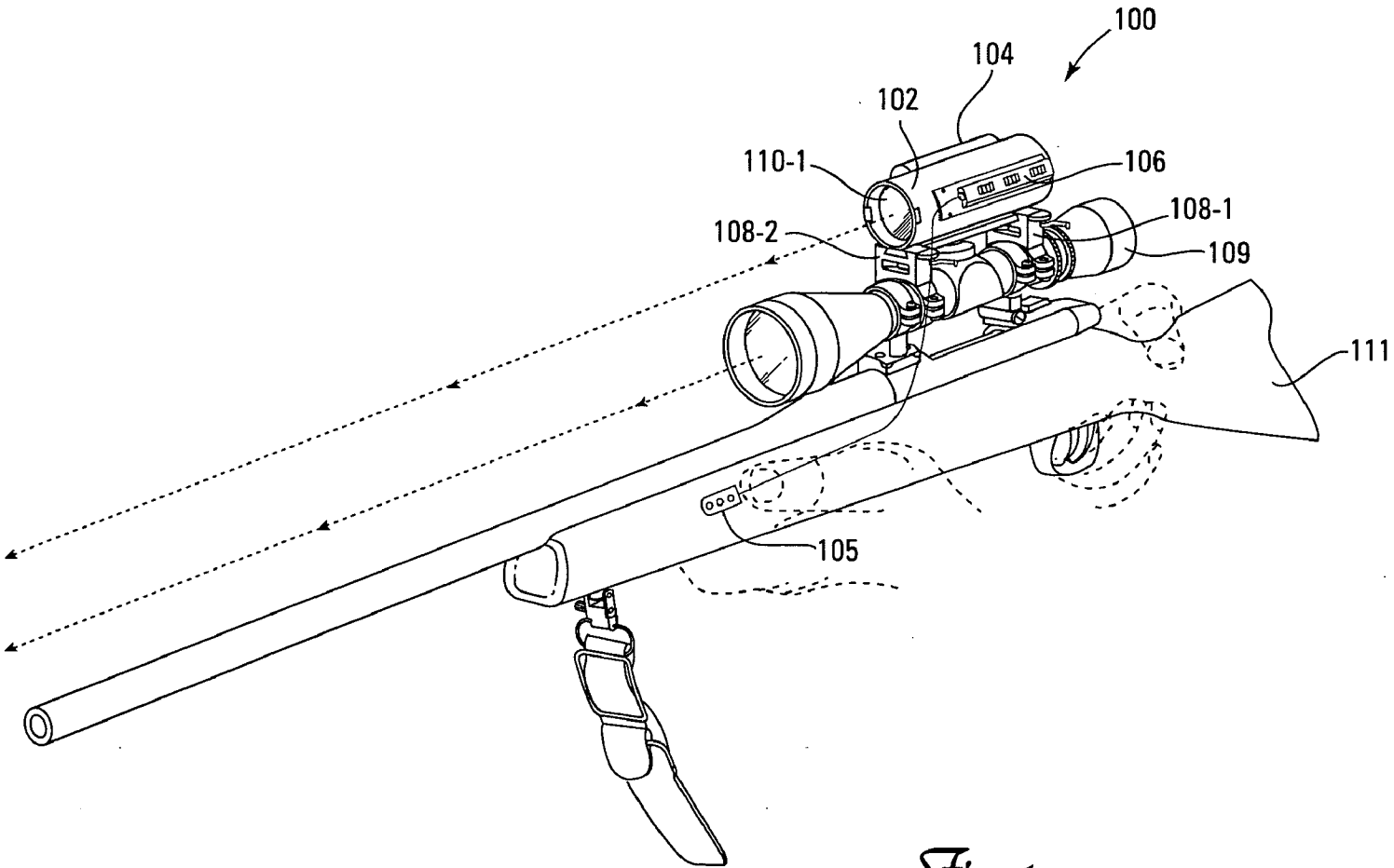
FIG. 1 is a perspective view of a rangefinder of one embodiment of the present invention mounted to a firearm.

Embodiments of the present invention relate to range finder that is adapted to be mounted to a firearm such as a rife, shotgun, pistol or the like. Referring to FIG. 1, a rangefinder 100 of one embodiment of the present invention is illustrated. As illustrated, the range finder includes a main housing 102 and a power supply housing 104. The main housing 102 encases signal lens 110-1 through which a radar signal is passed and received. Also illustrated in FIG. 1, is an operation panel 106 that is used to operate the range finder 100. The range finder 100 can also be operated by a remote unit 105. In particular, the remote unit 105 is adapted to be attached to a firearm in such a manner that it allows easy manipulation of the range finder 100. This feature is illustrated in FIG. 1. The range finder 100 in this embodiment is adapted to be mounted to a scope 109 that is in turn mounted to firearm 111. Moreover, in this embodiment the range finder 100 is mounted to the scope 109 with mounting brackets 108-1 and 108-2.

Figure 2:
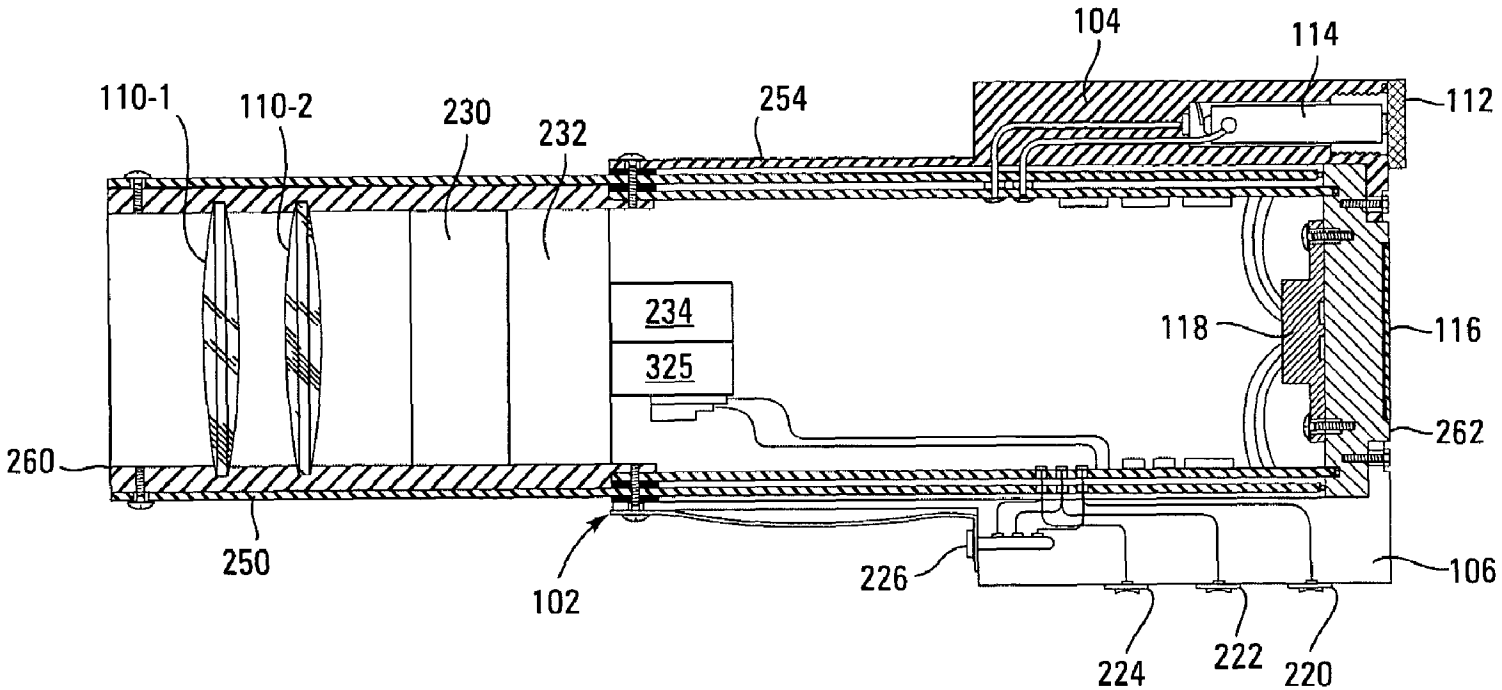
FIG. 2 is a cross-sectional view of the rangefinder of FIG. 1.

Referring to FIG. 2 a cross-sectional top view of the range finder 100 is illustrated. As illustrated, the main housing 102 includes a first section 250 and a second section 254. The first and second sections 250 and 254 are connected by a plurality of attaching screws. In other embodiments, other attaching means are used and this invention is not limited to the use of attaching screws. As illustrated, an inter attachment section 252 abuts the first section 250. The inter attachments section 252 is adapted to hold a first and second signal lens 110-1 and 110-2. Although, this embodiment uses two signal lenses 110-1 and 110-2, it will be understood in the art that other signal focusing method and other projection methods could be used and that this invention is not limited to two signal lenses 110-1 and 110-2. Also illustrated are signal generation circuit 230, signal receiving circuit 232, a process circuit 234 and a control circuit 235 that make up part of a range finding circuit. The signal generation circuit 230 is adapted to generate a signal that is projected out of the signal end 260 of the range finder 100. The signal receiving circuit 232 is adapted to receive signals reflected off of an object and reflected back through the signal end 260 of the range finder 100. The process circuit 234 is adapted to process the received signals to determine the distance to the object the signal was reflected off of. The control circuit 235 is adapted to control and synchronize the signal generation circuit 230, the signal receiving circuit 232 and the process circuit 234 based on operating signals provided by a user. In one embodiment, a signal propagation time measuring method is used to determine the distance to an object. In other embodiments, a light-section method or a binocular sterosis method or other similar methods are used. Accordingly, the present invention is not limited to a specific type of method of determining distances to an object.

Further illustrated in FIG. 2, is the power supply housing 104 in the second section 254 of the range finder 100. In this embodiment, the power supply 114 is a battery that is received in a cavity of the power supply housing 114. The power supply 114 is retained in the power supply housing with a threaded cap 112. In this embodiment, the display 116 is coupled to the display end 262 of the range finder 100. The display 116 is adapted to display indicia that represents the distance to an object when the range finder 100 is activated. In one embodiment the display is an LCD. A display circuit 118 is used to process signals from the processing circuit 234 and to direct the display 116 to display the distance. The control circuit 325 is controlled by operating switches 220, 222 and 224 on the operating panel 106 and alternately through the jack 226 which is selectively coupled to the remote unit 105. The control switches may include an on/off switch 224, an activation switch 220, a brightness control switch 222 and the like. In one embodiment, the switches are activation buttons 220, 222 and 224. As illustrated, the operating switches 220, 222 and 224 are connected to control the control circuit 325.

Figure 3:
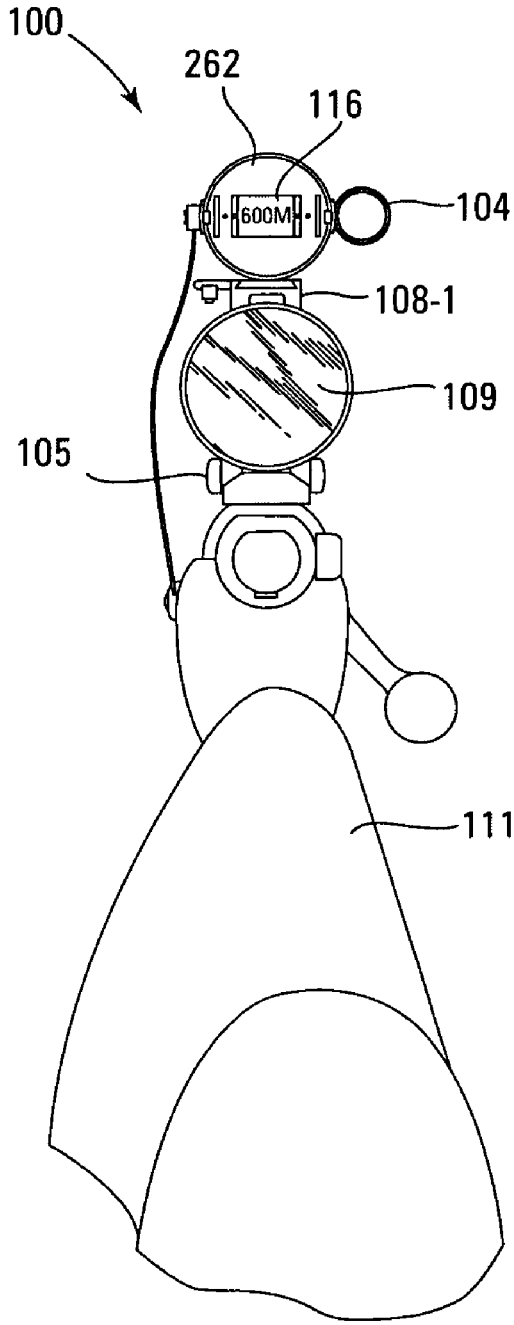
FIG. 3 is a rear view of the rangefinder coupled to a firearm of FIG. 1.
Figure 4:
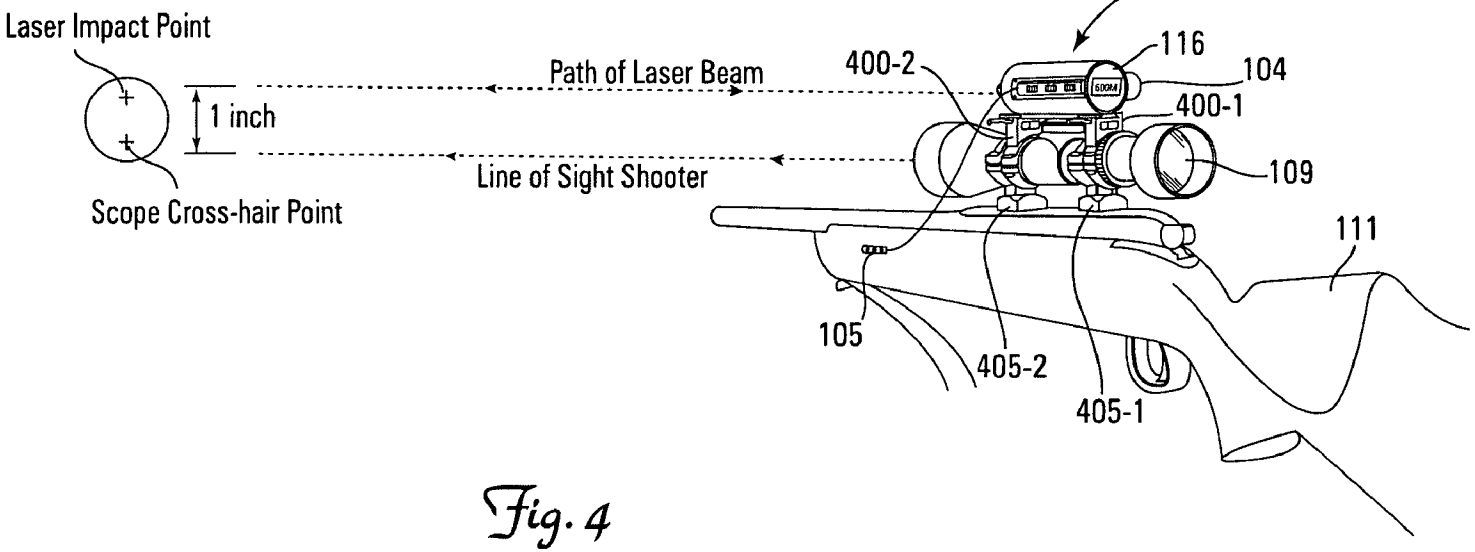
FIG. 4 is a perspective view the rangefinder coupled to a firearm of one embodiment of the present invention.

FIG. 3 illustrates a rear view of the range finder 100 coupled to a firearm 111. As illustrated, the range finder 100 includes the display 116 which is located on the display end 262. In one embodiment, the display 116 is encased in the display end 262 of range finder 100. In another embodiment, the display 116 extends from the display end 262 of the range finder 100. FIG. 4, is another perspective of the range finder 100 of the present invention. FIG. 4, illustrates the path of the beam or signal and the line of sight provided by the scope 109. In this embodiment, the mounting brackets 400-1 and 400-2 of the range finder 100 are integrated with the mounting brackets 405-1 and 405-2 that mount the scope 109 to the firearm 111. Mounting brackets 405-1 and 405-2 can be referred to as the receiver of the scope. Accordingly, in some embodiments of the present invention, the mounting mechanism of the scope is used to mount the range finder 100 to the scope. Further in some embodiments of the present invention where the range finder is directly mounted to a scope mount, a scope need not be present. This embodiment is especially useful for individuals who have eye problems or disabilities that do not allow them to use a scope. Further in this embodiment, when the scope is not attached, the user can simply use the iron sights on the firearm to aim through the scope ring of the scope mounting brackets.

Although specific embodiments have been illustrated and described herein, it will be appreciated by those of ordinary skill in the art that any arrangement, which is calculated to achieve the same purpose, may be substituted for the specific embodiment shown. This application is intended to cover any adaptations or variations of the present invention. Therefore, it is manifestly intended that this invention be limited only by the claims and the equivalents thereof.

What is claimed is:

1. A method of using a range finder with a weapon having a scope, the method comprising:

(a) attaching the range finder to a support mounted on top of the scope, which is mounted on top of the weapon so that the range finder, the scope, and the weapon are aligned in a common vertical plane, and a laser beam of the range finder and a sight line of the scope are parallel to each other;

(b) activating the range finder to measure distance to a target; and (c) displaying the measured distance.

2. The method of claim 1, wherein attaching the range finder to the support includes engaging the range finder with a mounting rail located on the support.

3. The method of claim 1, wherein the support is mounted on top of the scope by at least one scope ring.

4. The method of claim 1, wherein the scope is mounted on top of the weapon by at least one scope ring.

5. A system for use with a weapon having a scope, the system comprising:

a range finder;

a horizontally extending support plate for mounting the range finder above the scope, the support plate having a mounting rail; and at least one scope ring for surrounding the scope, the at least one scope ring having a clamp for clamping attachment to the mounting rail, wherein the at least one scope ring and support plate mount the range finder directly above the scope so that the rangefinder, the scope, and the weapon are aligned in a common vertical plane, and a laser beam of the range finder and a sight line of the scope are parallel to each other.

6. The system of claim 5, further comprising:

a screw for securing the clamping attachment between the scope ring and the mounting rail.

7. The system of claim 5, further comprising:

first and second mounting brackets for mounting the scope above the weapon, the first and second mounting brackets extending downwardly from the scope.

8. The system of claim 7, further comprising:

first and second spaced apart scope rings for surrounding the scope, wherein the first and second mounting brackets extend downwardly from the first and second scope rings, respectively.

9. The system of claim 8, further comprising:

third and fourth spaced apart scope rings for surrounding the scope.

10. The system of claim 9, further comprising:

third and fourth mounting brackets extending vertically upwards from the third and fourth scope rings, respectively, wherein the support plate extends horizontally between the third and fourth mounting brackets.

11. The system of claim 10, wherein the mounting rail of the support plate couples with the third and fourth mounting brackets.

12. A system for use with a weapon having a scope, the system comprising:

a range finder comprising:

a body having a signal end and a display end opposite the signal end;

a circuit for projecting signals and receiving reflected signals through the signal end; and a display coupled to the display end, the display for displaying distances determined by the circuit; and a mounting mechanism for mounting the range finder to the scope, the mounting mechanism comprising:

a horizontally extending support plate for supporting the range finder above the scope; and at least one scope ring having a lower end for surrounding the scope and an upper end for attaching to the support plate, wherein the at least one scope ring and support plate mount the range finder directly above the scope so that the rangefinder, the scope, and the weapon are aligned in a common vertical plane, and a signal of the range finder and a sight line of the scope are parallel to each other.

13. The system of claim 12, wherein the range finder further comprises:

an operation panel having at least one control switch.

14. The system of claim 12, wherein the range finder further comprises:

a remote control unit for operating the range finder.

* * * * *